US008545129B2

(12) United States Patent
Weekly et al.

(10) Patent No.: US 8,545,129 B2
(45) Date of Patent: Oct. 1, 2013

(54) COFFERDAM MODULES

(75) Inventors: Todd O. Weekly, Idleyld Park, OR (US); Nicholas O. Weekly, Idleyld Park, OR (US)

(73) Assignee: Weekly Bros. Inc., Idleyld, OR (US)

( * ) Notice: Subject to any disclaimer, the term of this patent is extended or adjusted under 35 U.S.C. 154(b) by 122 days.

(21) Appl. No.: 13/041,174

(22) Filed: Mar. 4, 2011

(65) Prior Publication Data

US 2012/0224920 A1 Sep. 6, 2012

(51) Int. Cl.
*E02D 19/04* (2006.01)

(52) U.S. Cl.
USPC ..... 405/11; 405/272; 405/282

(58) Field of Classification Search
USPC ..... 405/11, 14, 272, 282, 283, 284, 285
See application file for complete search history.

(56) References Cited

U.S. PATENT DOCUMENTS

| | | | | | |
|---|---|---|---|---|---|
| 1,980,055 | A * | 11/1934 | Healy et al. | ..... | 405/14 |
| 2,001,473 | A * | 5/1935 | Smith | ..... | 405/14 |
| 2,063,514 | A * | 12/1936 | Meem | ..... | 405/14 |
| 2,073,545 | A * | 3/1937 | Atkinson | ..... | 405/14 |
| 2,179,429 | A * | 11/1939 | Schiavi | ..... | 405/14 |
| 3,720,067 | A * | 3/1973 | Aubert | ..... | 405/107 |
| 4,110,990 | A * | 9/1978 | Thompson et al. | ..... | 405/14 |
| 4,487,530 | A * | 12/1984 | Morrice | ..... | 405/282 |
| 4,648,752 | A * | 3/1987 | Guy et al. | ..... | 405/14 |
| 5,096,334 | A * | 3/1992 | Plank | ..... | 405/282 |
| 5,302,054 | A * | 4/1994 | Winkler et al. | ..... | 405/282 |
| 6,485,230 | B2 * | 11/2002 | Robinson | ..... | 405/112 |
| 2007/0116522 | A1 * | 5/2007 | Boudreaux | ..... | 405/114 |
| 2010/0074687 | A1 * | 3/2010 | Boudreaux, Jr. | ..... | 405/114 |

* cited by examiner

*Primary Examiner* — Frederick L Lagman
(74) *Attorney, Agent, or Firm* — Marger, Johnson & McCollom, P.C.

(57) ABSTRACT

A cofferdam module can include first and second side panels, outer support members that are each coupled to the outer side of one of the side panels, and two different types of inner support members that are each coupled to the inner side of each of the side panels.

17 Claims, 8 Drawing Sheets

COFFERDAM MODULES

TECHNICAL FIELD

The disclosed technology pertains to cofferdams and, more particularly, to cofferdam modules that may be used to construct a cofferdam.

BACKGROUND

Cofferdams are typically used to create a temporary dry work environment by isolating certain areas that would otherwise be part of a waterway such as a river, lake or reservoir. There are a number of concerns when constructing cofferdams such as logs or other objects that may be carried by the waterway into the cofferdam. Further, riverbed conditions can be problematic. For example, overly rocky or sandy riverbeds can make the construction of a cofferdam particularly difficult. In addition, flooding conditions can cause water to go over the top of a cofferdam structure and potentially weaken the support structure of the cofferdam. In extreme worst-case scenarios, a cofferdam may be effectively or entirely swept away by the very waterway it is trying to curb. Site constraints are often factors as well. For example, there may limited access to an area in which a cofferdam is to be constructed.

There remains a need for a way to address these and other problems associated with the prior art.

DETAILED DESCRIPTION

Figure 1A:
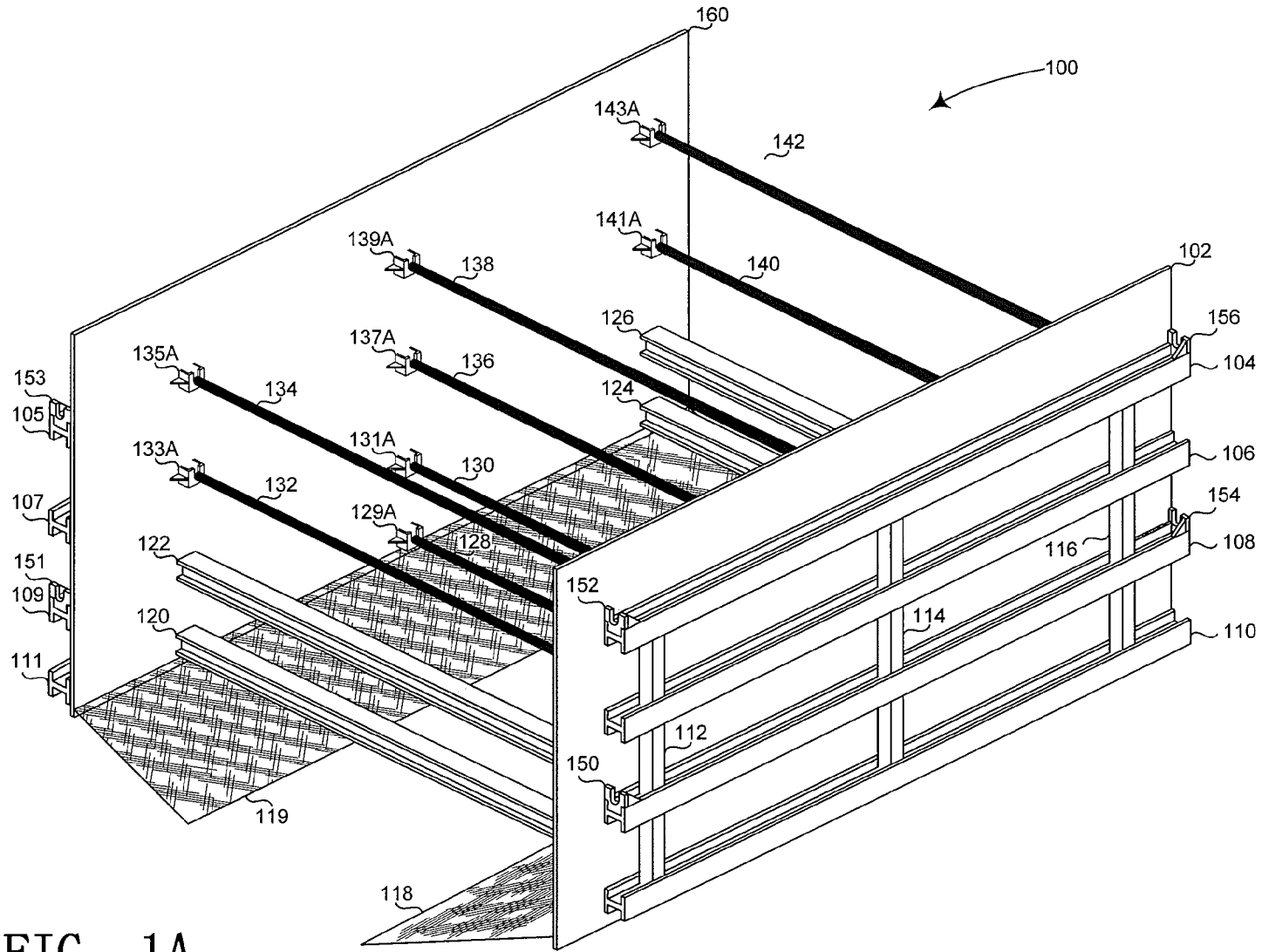
FIG. 1A illustrates a front perspective view of a first embodiment of a cofferdam module in accordance with the disclosed technology.

FIG. 1 illustrates a first embodiment of a cofferdam module 100 in accordance with the disclosed technology. In particular, FIG. 1A illustrates a front perspective view of the cofferdam module 100, FIG. 1B illustrates a left side elevation view of the cofferdam module 100, FIG. 1C illustrates a right side elevation view of the cofferdam module 100, and FIG. 1D illustrates a front elevation view of the cofferdam module 100.

In the example, the cofferdam module 100 includes a first side panel 102 and a second side panel 160. In certain embodiments, the first side panel 102 and second side panel 160 are steel plates that each have a length of 20', a height of 12', and a thickness of ½". In other embodiments, either or both of the first side panel 102 and second side panel 160 may be made of other material and/or may have different dimensions. For example, the first side panel 102 and second side panel 160 may be steel plates having a length of 20' and a height of either 10' or 8'.

In the example, the cofferdam module 100 includes four horizontal outer support beams 104, 106, 108, and 110 and three vertical outer support beams 112, 114, and 116 that are all coupled to the first side panel 102. The four horizontal outer support beams 104, 106, 108, and 110 may be spaced apart from each other in a uniform manner or otherwise. For example, the first horizontal outer support beam 104 may be situated substantially 1' below the top edge of the first side panel 102, the second horizontal outer support beam 106 may be situated substantially 3' below the first horizontal outer support beam 104, the third horizontal outer support beam 106 may be situated substantially 3'6" below the second horizontal outer support beam 104, and the fourth horizontal outer support beam 108 may be situated substantially 3'6" below the third horizontal outer support beam 106 such that it is situated substantially 1' above the bottom edge of the first side panel 102.

Figure 1B:
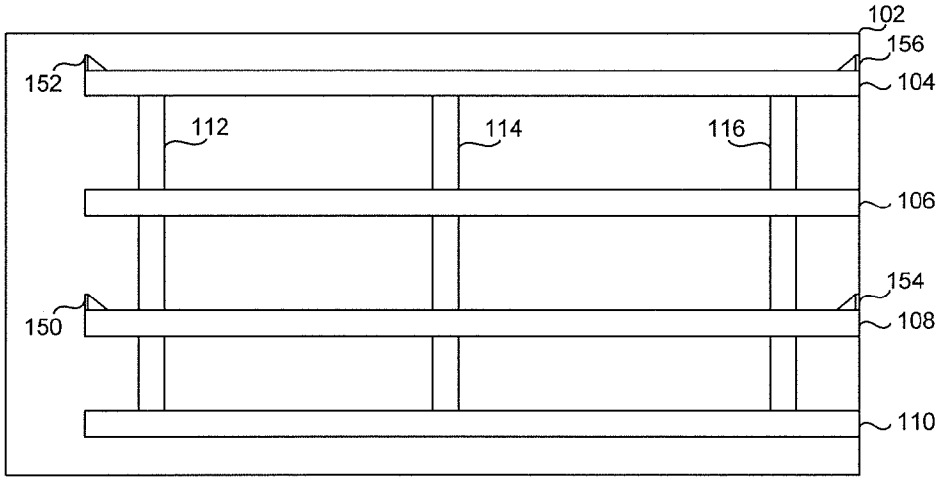
FIG. 1B illustrates a left side elevation view of the first embodiment of a cofferdam module in accordance with the disclosed technology.
Figure 1C:
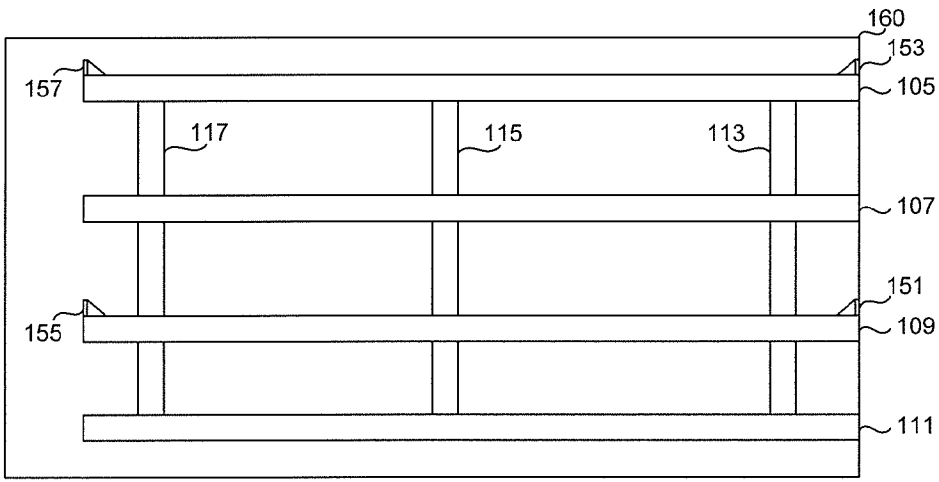
FIG. 1C illustrates a right side elevation view of the first embodiment of a cofferdam module in accordance with the disclosed technology.

In certain embodiments, each of the horizontal support beams 104, 106, 108, and 110 are I-beams or W-beams such as W10×22 steel beams that are substantially 18' in length and each of the vertical support beams 112, 114, and 116 are substantially 10' in length. Other outer support beams, e.g., 105, 107, 109, 111, 113, 115, and 117 as illustrated in FIG. 1C, are coupled to the second side panel 160 in a manner similar to that of the outer support beams 104, 106, 108, 110, 112, 114, and 116 that are coupled to the first side panel 102 as illustrated in FIG. 1B.

In the example, the cofferdam module 100 also includes four inner beams 120, 122, 124, and 126 that are each coupled to the first side panel 102 and the second side panel 160. For example, each of the inner beams 120, 122, 124, and 126 may be attached, e.g., welded, to the first side panel 102 and second side panel 160. In certain embodiments, the inner beams 120, 122, 124, and 126 are I-beams or W-beams such as W8×10 steel beams that are substantially 18' in length. The inner beams 120, 122, 124, and 126 may be fixed tieback rods.

In the example, the cofferdam module 100 also includes eight inner rods 128, 130, 132, 134, 136, 138, 140, and 142 that are each coupled to the second side panel 160 by way of connecting members 129A, 131A, 133A, 135A, 137A, 139A, 141A, and 143A, respectively. In certain embodiments, each of the connecting members 129A, 131A, 133A, 135A, 137A, 139A, 141A, and 143A are slotted side tie brackets, e.g., they each have a slot configured to receive one end of the eight inner rods 128, 130, 132, 134, 136, 138, 140, and 142, respectively, such that each inner rod may be dropped into the slot of the corresponding bracket and attached to the bracket by way of bolting, for example.

Figure 1D:
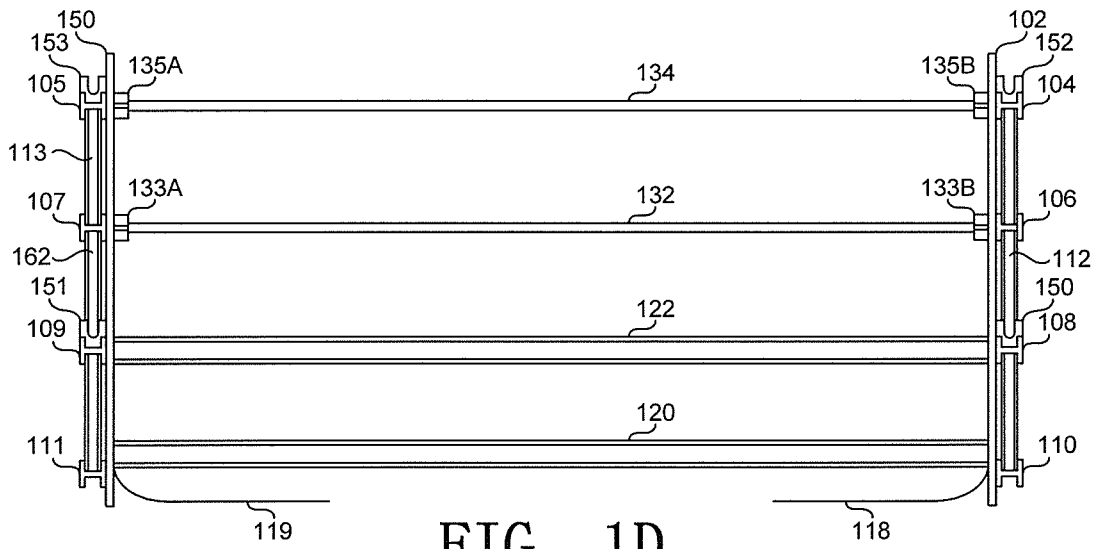
FIG. 1D illustrates a front elevation view of the first embodiment of a cofferdam module in accordance with the disclosed technology.

In the example, the inner rods 128, 130, 132, 134, 136, 138, 140, and 142 are also coupled to the first side panel 102 by way of other corresponding connecting members, e.g., 133B and 135B as illustrated in FIG. 1D. In certain embodiments, each of the inner rods 128, 130, 132, 134, 136, 138, 140, and 142 are tieback rods having a diameter of 1¼" and threading at one or both ends such that they may be bolted to the connecting members 129A, 131A, 133A, 135A, 137A, 139A, 141A, and 143A, respectively, for easy assembly and later removal.

In the example, the cofferdam module 100 also includes two pieces of geotextile material 118 and 119 that are coupled to the first and second side walls 102 and 160, respectively. For example, the pieces of geotextile material 118 and 119 may be bolted to the first and second side panels 102 and 160, respectively. The pieces of geotextile material 118 and 119 may serve to prevent the passage of inner material such as rocks and fines, e.g., silts and sands, in the cofferdam module 100 from exiting the cofferdam module 100, for example. Materials such as fines generally assist in maintaining a seal and the geotextile material 118 and 119 are typically made of a woven material that acts like a coffee filter in that it keeps fines from escaping the cofferdam module 100 but allows water to exit. In certain embodiments, one or both of the pieces of geotextile material 118 and 119 may have a length of 18' and a width of 4' or 6'.

In the example, the cofferdam module 100 also includes a number of slotted side tie brackets. Two slotted side tie brackets 150 and 154 are coupled to, e.g., welded to, one of the outer support beams 108 that is coupled to the first side panel 102, and two other slotted side tie brackets 152 and 156 are coupled to, e.g., welded to, another one of the outer support beams 104 that is coupled to the first side panel 102. Further, two slotted side tie brackets 151 and 155 are coupled to, e.g., welded to, one of the outer support beams 109 that is coupled to the second side panel 160, and two other slotted side tie brackets 153 and 157 are coupled to, e.g., welded to, another one of the outer support beams 105 that is coupled to the second side panel 160.

In certain embodiments, one or more of the slotted side tie brackets 150-157 may be used to couple the cofferdam module 100 with one or more adjacent cofferdam modules during construction of a cofferdam. For example, once construction of the cofferdam module 100 is at least partially completed, another cofferdam module may be constructed proximate thereto. Slotted side tie brackets on the other cofferdam module may be positioned adjacent to slotted side brackets on the cofferdam module 100, such as the slotted side tie brackets 150-153 illustrated in FIG. 1D, such that a connecting member, e.g., a steel rod, may be dropped into each corresponding pair of slotted side tie brackets and attached, e.g., bolted, thereto.

Figure 2:
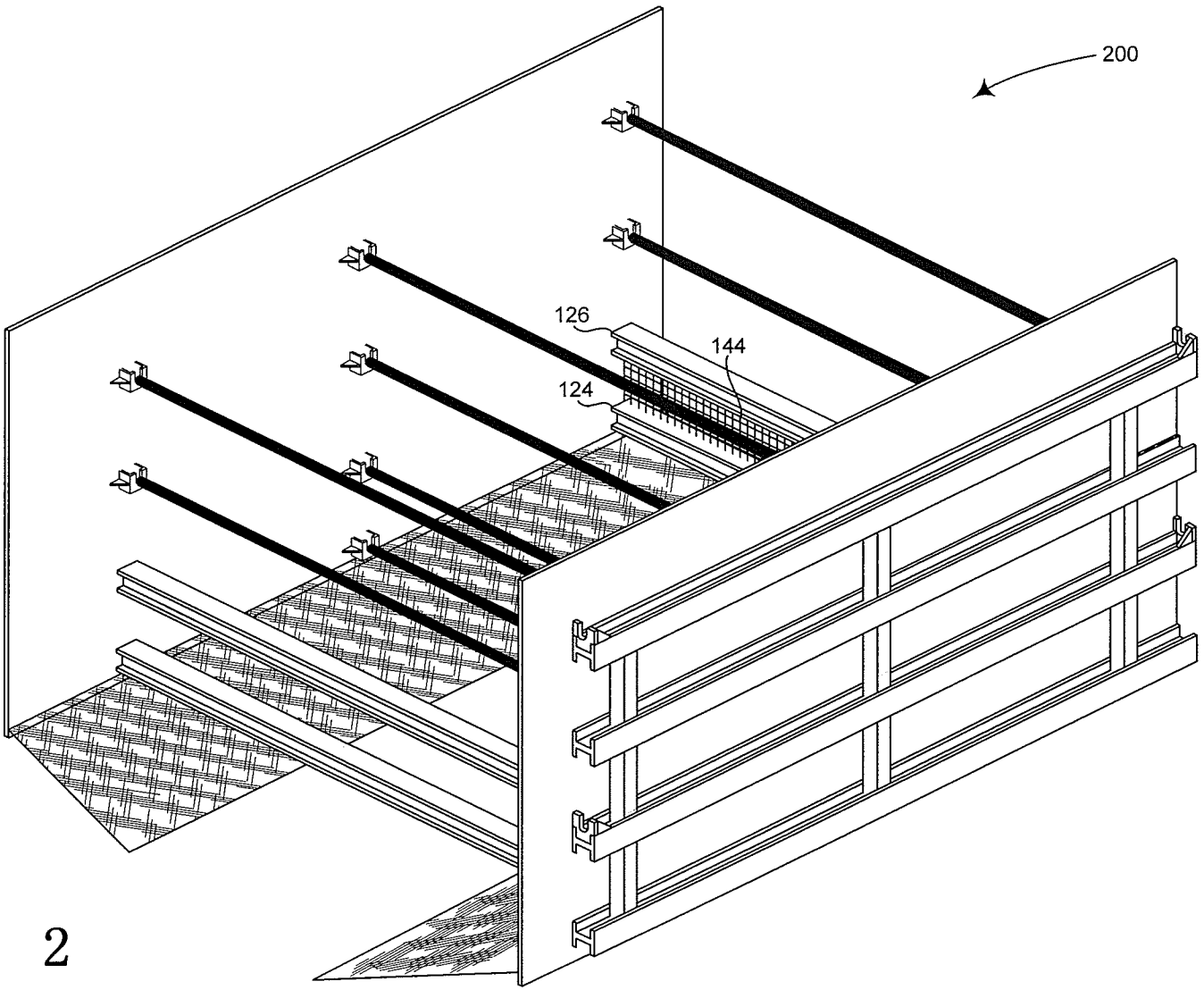
FIG. 2 illustrates a front perspective view of a second embodiment of a cofferdam module in accordance with the disclosed technology.

FIG. 2 illustrates a second embodiment of a cofferdam module 200 in accordance with the disclosed technology. The cofferdam module 200 illustrated in FIG. 2 is similar to the cofferdam module 100 illustrated in FIG. 1 but, unlike the cofferdam module 100 illustrated in FIG. 1, the cofferdam module 200 illustrated in FIG. 2 includes a mesh, e.g., wire screen 144 that is disposed between two of the inner beams 124 and 126. The wire screen 144 may serve to retain filling material during construction of the cofferdam module 100 or an adjacent cofferdam module, for example. In certain embodiments, the wire screen 144 may be placed 2' from the downstream end of the cofferdam module 200.

Figure 3:
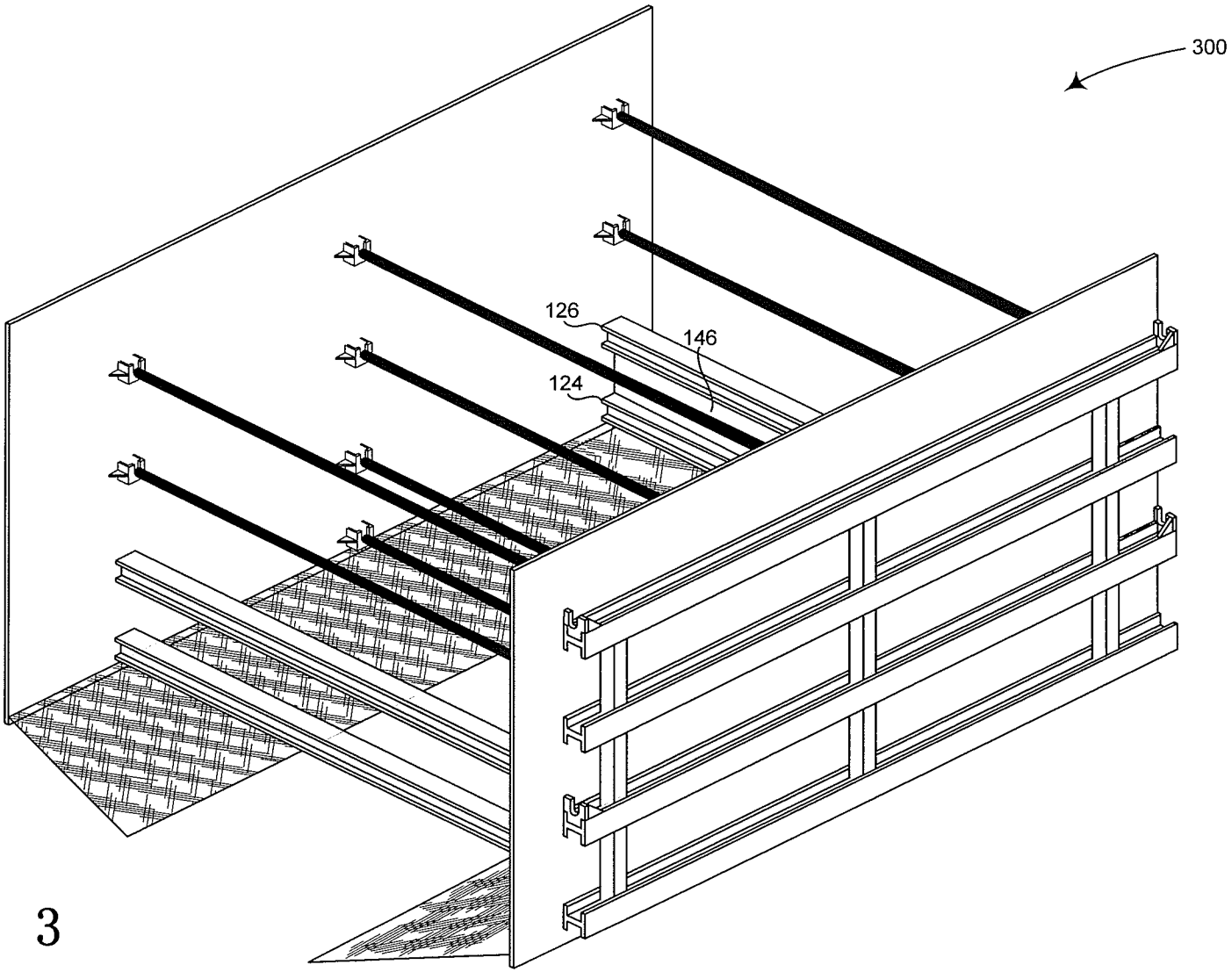
FIG. 3 illustrates a front perspective view of a third embodiment of a cofferdam module in accordance with the disclosed technology.

FIG. 3 illustrates a third embodiment of a cofferdam module 300 in accordance with the disclosed technology. The cofferdam module 300 illustrated in FIG. 3 is similar to the cofferdam module 200 illustrated in FIG. 2 but, whereas the cofferdam module 200 of FIG. 2 has a wire screen 144 between the two inner beams 124 and 126, the cofferdam module 300 illustrated in FIG. 3 includes a plate 146 that is disposed between the two inner beams 124 and 126.

In certain embodiments, the plate 146 may be even more effective than the wire screen 144 of FIG. 2 in retaining filling material during construction of the cofferdam module 300 or an adjacent cofferdam module, for example. In certain embodiments, the plate 146 may be a steel plate having a thickness of ½". One having ordinary skill in the art will appreciate that the plate 146 may be made of a material other than steel. In certain embodiments, the plate 146 may be placed 2' from the downstream end of the cofferdam module 200.

Figure 4:
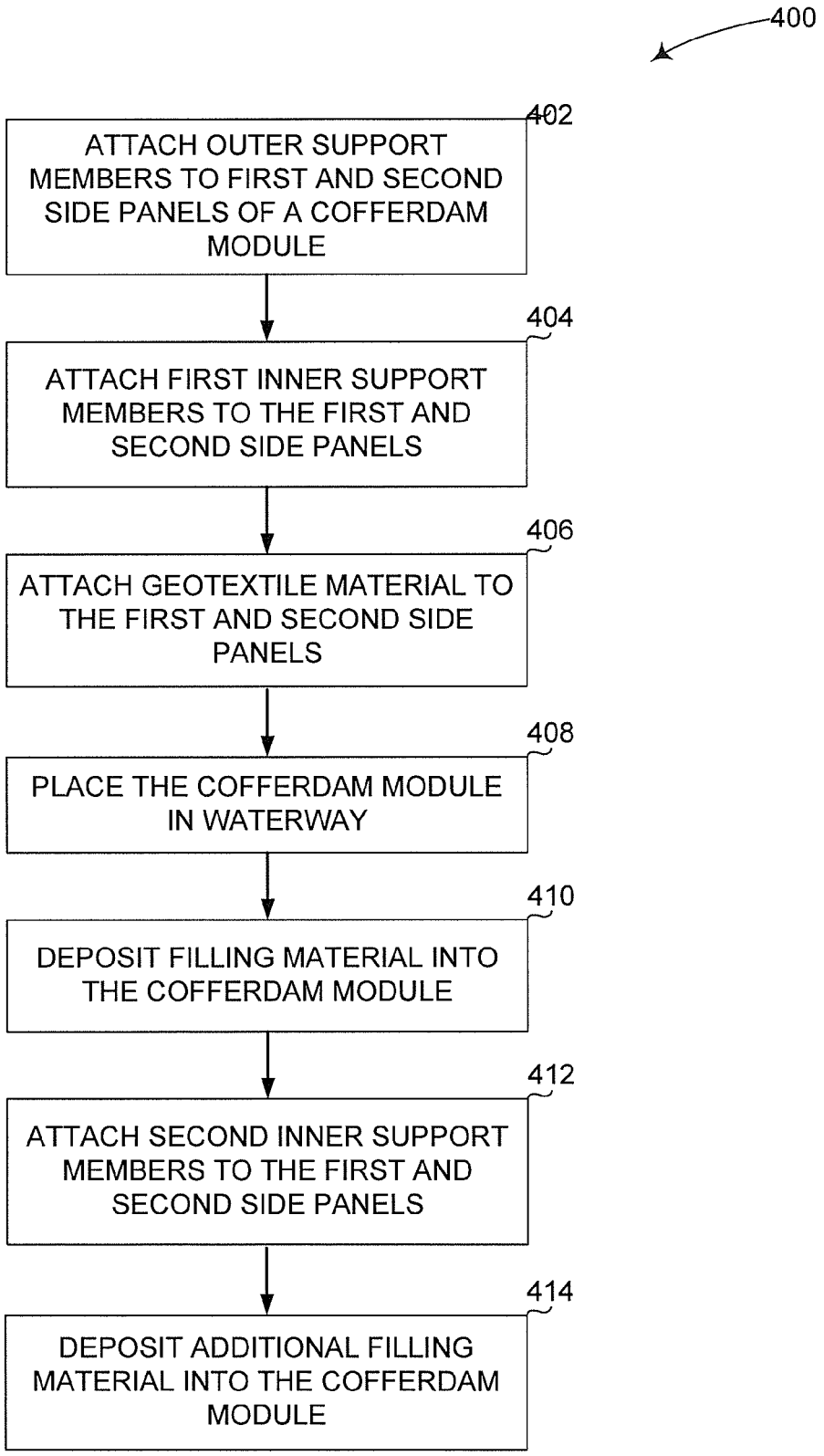
FIG. 4 illustrates a method of constructing a cofferdam module in accordance with the disclosed technology.

FIG. 4 illustrates a method 400 of constructing a cofferdam module in accordance with the disclosed technology. At 402, outer support members, such as the four horizontal outer support beams 104, 106, 108, and 110 and three vertical outer support beams 112, 114, and 116 illustrated in FIG. 1, are coupled to, e.g., welded to, first and second side panels of a cofferdam module, such as the first and second side panels 102 and 160 of the cofferdam module 100 illustrated in FIG. 1.

At 404, one or more of a first plurality of inner support members, such as the four inner beams 120, 122, 124, and 126 illustrated in FIG. 1, are coupled to, e.g., welded to, the first and second side panels. The first plurality of inner support members may also include inner rods such as the first two inner rods 128 and 130 illustrated in FIG. 1, which may be dropped into corresponding slots in connecting members, such as the connecting members 129A and 131A, and bolted into place. One or more of the first plurality of inner support members may be placed into position before coupling using designated construction equipment, for example.

At 406, geotextile material, such as the two pieces of geotextile material 118 and 119 illustrated in FIG. 1, are coupled to, e.g., bolted to, the first and second side panels. Once each of the first plurality of inner support members and the geotextile material have all been coupled to the first and second side panels, the cofferdam module may be placed into a waterway, as shown at 408.

At 410, filling material may be deposited into the cofferdam module. The filling material may include a mixture of one or more materials such as native sands and gravel, for example. In certain embodiments, the filling material may include bar run, e.g., a sand and gravel mixture containing rocks that are generally between 1" and 8" in size. In certain embodiments, the filling material may be deposited until it reaches a certain level, e.g., approximately halfway between the top and bottom edges of the first and second side panels. Machinery or equipment, such as an excavator, may be used on the top surface of the filling material to facilitate the construction of an adjacent cofferdam module, for example. At 412, one or more of a second plurality of inner support members, such as the remaining six inner rods 132, 134, 136, 138, 140, and 142 illustrated in FIG. 1, are coupled to the first and second side panels. For example, each of the second plurality of inner support members may be dropped into corresponding slots in connecting members, such as the connecting members 133A, 135A, 137A, 139A, 141A, and 143A illustrated in FIG. 1, and bolted into place. Once each of the second plurality of inner support members have been coupled to the first and second side panels, additional filling material may be placed into the cofferdam module, as shown at 414. The additional filling material may include the same type of material as the filling material at 410 or it may be a mixture of one or more different materials.

Figure 5A:
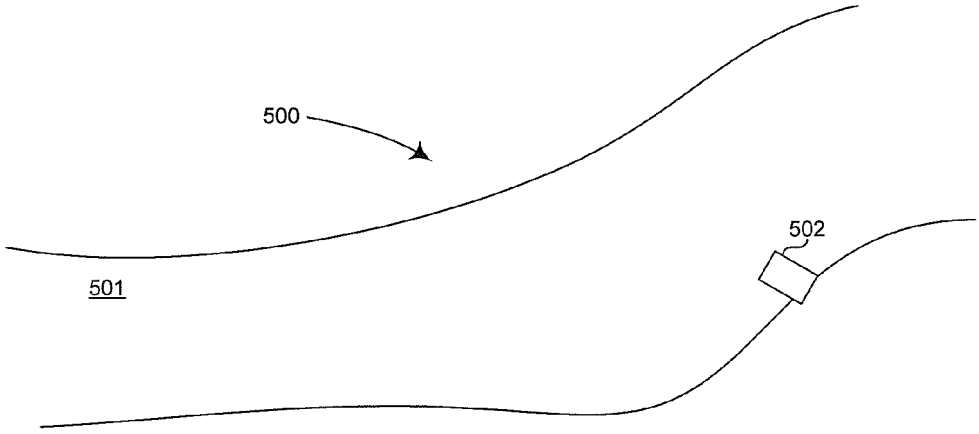
FIG. 5 illustrates an example of a cofferdam constructed from a number of cofferdam modules in accordance with the disclosed technology.
Figure 5B:
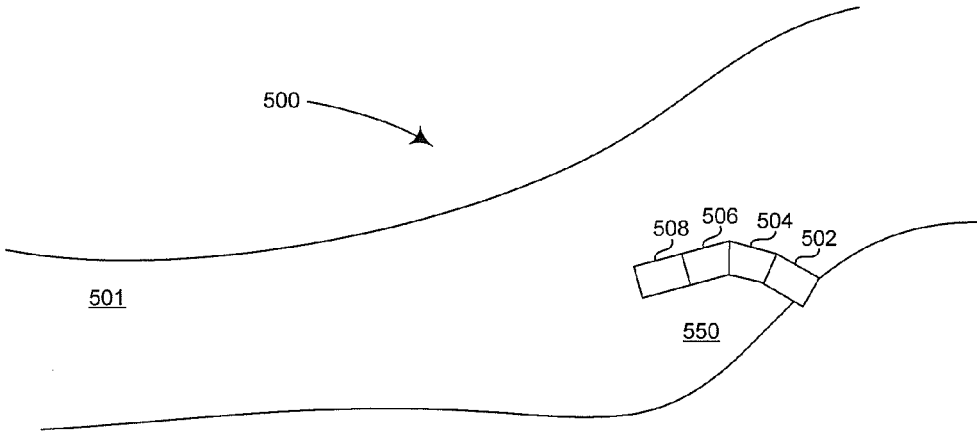
Figure 5C:
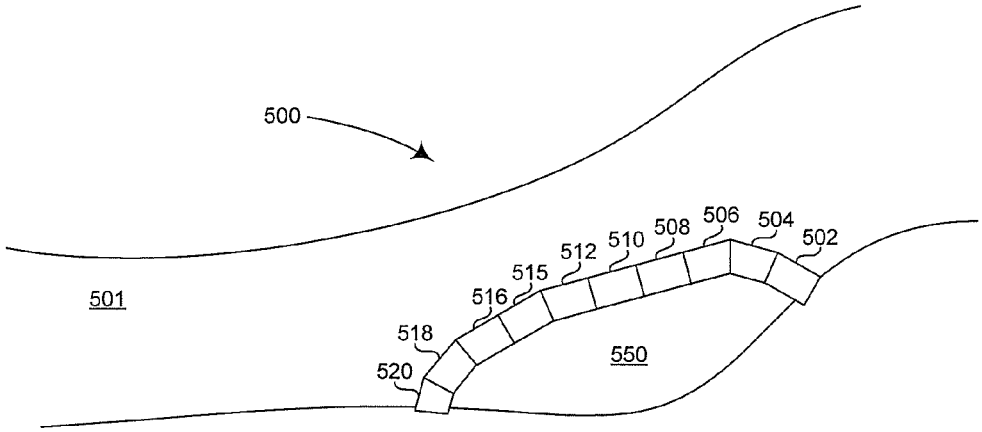

FIG. 5 illustrates an example of a cofferdam 500 constructed from a number of cofferdam modules 502-520 in a waterway 501, such as a lake, river, or reservoir, in accordance with the disclosed technology. In particular, FIG. 5A illustrates an initial stage of constructing the cofferdam 500 in the waterway 501, FIG. 5B illustrates an intermediate stage of constructing the cofferdam 500 in the waterway 501, and FIG. 5C illustrates a final stage of constructing the cofferdam 500 in the waterway 501.

FIG. 5A illustrates an initial stage of constructing the cofferdam 500 in the waterway 501 in which only a single cofferdam module 502, such as the cofferdam module 100 of FIG. 1, has been constructed. Because the cofferdam module 502 is the first cofferdam module to be constructed, it is not completely situated within the waterway 501.

FIG. 5B illustrates an intermediate stage of constructing the cofferdam 500 in which four cofferdam modules 502, 504, 506, and 508 have been constructed and a dry workplace area 550 is beginning to take shape. Each of these first four cofferdam modules 502, 504, 506, and 508 is adjacent to at least one other cofferdam module. For example, construction of the second cofferdam module 504 may begin once construction of the first cofferdam module 502 is at least substantially complete, construction of the third cofferdam module 506 may begin once construction of the second cofferdam module 504 is at least substantially complete, and so on.

FIG. 5C illustrates a final stage of constructing the cofferdam 500 in the waterway 501 in which all ten cofferdam modules 502-520 have been constructed. Each of the ten cofferdam modules 502-520 is adjacent to at least one other cofferdam module. Neither of the first or last cofferdam modules 502 and 520 are completely situated in the waterway 501. The dry workplace area 550 is now fully formed and workers may begin to undertake whatever construction projects are to occur within the dry workplace area 550 such as a fish ladder, for example.

Figure 6:
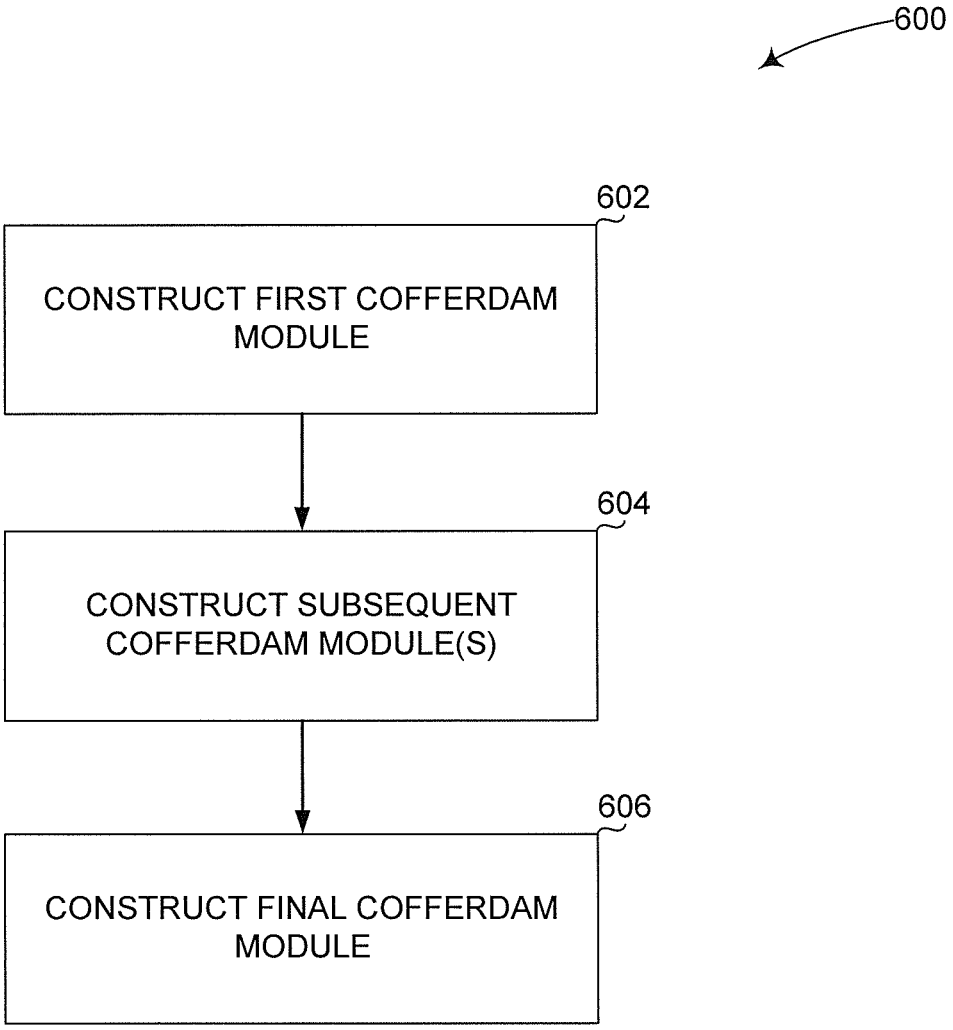
FIG. 6 illustrates a method of constructing a cofferdam in accordance with the disclosed technology.

FIG. 6 illustrates a method 600 of constructing a cofferdam in accordance with the disclosed technology. At 602, a first cofferdam module, such as the first cofferdam module 502 illustrated in FIG. 5, is constructed. Once the first cofferdam module has been at least substantially completed, a second cofferdam module, such as the second cofferdam module 504 illustrated in FIG. 5, is constructed, as shown at 604. The method 600 continues until the final cofferdam module, such as the final cofferdam module 520 illustrated in FIG. 5, is fully constructed, as shown at 606. A dry workplace area, such as the workplace area 550 illustrated in FIG. 5, is now available for whatever construction projects are to occur there.

Having described and illustrated the principles of the invention with reference to illustrated embodiments, it will be recognized that the illustrated embodiments may be modified in arrangement and detail without departing from such principles, and may be combined in any desired manner. And although the foregoing discussion has focused on particular embodiments, other configurations are contemplated. In particular, even though expressions such as "according to an embodiment" or the like are used herein, these phrases are meant to generally reference embodiment possibilities, and are not intended to limit the invention to particular embodiment configurations. As used herein, these terms may reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. A cofferdam module, comprising:

a first side panel having a height;

a second side panel having a height;

a first plurality of outer support members coupled to an outer side of the first side panel, the first plurality of outer support members comprising no more than four horizontal beams;

a second plurality of outer support members coupled to an outer side of the second panel, the second plurality of outer support members comprising no more than four horizontal beams;

a first plurality of inner support members coupled only to a bottom half of an inner side of the first side panel and a bottom half of an inner side of the second side panel, the first plurality of inner support members comprising no more than four support beams, wherein each of the first plurality of inner support members has a length that is greater than the height of the first side panel and also greater than the height of the second side panel; and a second plurality of inner support members coupled only to a top half of the inner side of the first side panel and a top half of the inner side of the second side panel, wherein the first and second pluralities of inner support members are different in form, and wherein each of the first plurality of inner support members is at least substantially parallel to each other and also to each of the second plurality of inner support members.

2. The cofferdam module of claim 1, wherein at least one of the first and second side panels comprises a steel plate.

3. The cofferdam module of claim 2, wherein the steel plate has a thickness of ½".

4. The cofferdam module of claim 1, wherein each of the first plurality of outer support members is a W10×22 steel beam.

5. The cofferdam module of claim 4, wherein each of the second plurality of outer support members is a W10×22 steel beam.

6. The cofferdam module of claim 1, wherein four of the first plurality of inner support members are W8×10 steel beams.

7. The cofferdam module of claim 6, wherein two of the first plurality of inner support members are 1¼" tieback rods.

8. The cofferdam module of claim 1, wherein each of the second plurality of inner support members is a 1¼" tieback rod.

9. The cofferdam module of claim 8, further comprising a second plurality of connecting members attached to the inner side of the second side panel, wherein each of the second plurality of inner support members is bolted to a corresponding one of the second plurality of connecting members.

10. The cofferdam module of claim 1, further comprising a first plurality of connecting members attached to the inner side of the first side panel, wherein each of the second plurality of inner support members is bolted to a corresponding one of the first plurality of connecting members.

11. The cofferdam module of claim 1, further comprising a first piece of geotextile material coupled to the first side panel.

12. The cofferdam module of claim 11, further comprising a second piece of geotextile material coupled to the second side panel.

13. The cofferdam module of claim 12, wherein the first piece of geotextile material is bolted to the first side panel and the second piece of geotextile material is bolted to the second side panel.

14. The cofferdam module of claim 11, wherein the first piece of geotextile material comprises a woven material.

15. A method of constructing a cofferdam module, comprising:

coupling a plurality of outer support members to each of first and second side panels, the plurality of outer support members comprising no more than four horizontal beams;

coupling each of a first plurality of inner support members to the first and second side panels, the first plurality of inner support members comprising no more than four horizontal beams and two horizontal rods, wherein each of the first plurality of inner support members has a length that is greater than a height of the first side panel and a height of the second side panel;

placing the first and second side panels into a waterway;

depositing filling material into the cofferdam module until it reaches a level between top and bottom edges of each of the first and second side panels;

coupling each of a second plurality of inner support members to the first and second side panels; and depositing additional filling material into the cofferdam module.

16. The method of claim 15, wherein each of the plurality of outer support members is a W10×22 steel beam.

17. The method of claim 15, the plurality of outer support members further comprising no more than three vertical beams.

* * * * *